US011292049B2

(12) United States Patent
Hsu et al.

(10) Patent No.: US 11,292,049 B2
(45) Date of Patent: Apr. 5, 2022

(54) ELECTRIC RIVET NUT MACHINE

(71) Applicant: TECHWAY INDUSTRIAL CO., LTD., Taichung (TW)

(72) Inventors: Chih-Hua Hsu, Taichung (TW); Rui-Heng Lin, Taichung (TW); Yi-Tsun Lai, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/245,508

(22) Filed: Apr. 30, 2021

(65) Prior Publication Data

US 2022/0062972 A1 Mar. 3, 2022

(30) Foreign Application Priority Data

Aug. 25, 2020 (TW) ..... 109128959

(51) Int. Cl.

| | |
|---|---|
| ***B21J 15/10*** | (2006.01) |
| ***B25F 5/00*** | (2006.01) |
| ***B25B 27/00*** | (2006.01) |
| ***B21J 15/26*** | (2006.01) |
| ***B21J 15/28*** | (2006.01) |
| ***B21J 15/12*** | (2006.01) |

(52) U.S. Cl.

CPC ..... *B21J 15/105* (2013.01); *B21J 15/12* (2013.01); *B21J 15/26* (2013.01); *B21J 15/28* (2013.01); *B25B 27/0014* (2013.01); *B25F 5/001* (2013.01)

(58) Field of Classification Search

CPC .. B25B 27/0014; B25B 21/001; B21J 15/105; B21J 15/12; B21J 15/26; B21J 15/28–285; B25F 5/001

See application file for complete search history.

(56) References Cited

U.S. PATENT DOCUMENTS 3,181,338 A * 5/1965 Zetterlund ..... B25B 27/0014 72/391.8
3,410,128 A * 11/1968 Sauter ..... B21J 15/105 29/243.526
5,238,461 A * 8/1993 Gotman ..... B25B 13/488 475/248
5,473,805 A * 12/1995 Wille ..... B21J 15/26 29/243.526
5,540,629 A * 7/1996 Gotman ..... B25B 13/488 475/248
5,605,070 A * 2/1997 Wille ..... F16D 41/206 72/391.4

(Continued)

*Primary Examiner* — Matthew P Travers

(74) *Attorney, Agent, or Firm* — Guice Patents PLLC

(57) ABSTRACT

An electric rivet nut machine comprises a motor having a first output shaft and a second output shaft; the first output shaft is connected with a first gear set, and the second output shaft is connected with a second gear set; and a rivet nut drive unit having a rivet nut shaft, a coupling gear and a moving gear; the coupling gear is engaged with the second gear set; the moving gear is engaged with the first gear set; through the first gear set and the second gear set of the motor respectively engaging with the rivet nut drive unit, and through the first output shaft and the second output shaft at two ends of the motor respectively engaging with the first gear set and the second gear set, different gear ratios can be formed, and better gear drive ratio can be produced for the rivet nut drive unit.

17 Claims, 7 Drawing Sheets

(56) References Cited

U.S. PATENT DOCUMENTS

| | | | | |
|---|---|---|---|---|
| 2008/0012453 | A1* | 1/2008 | Aasgaard | B21J 15/26 310/75 R |
| 2010/0295696 | A1* | 11/2010 | Chu | B25B 27/0014 340/686.1 |
| 2011/0239449 | A1* | 10/2011 | Masugata | B21J 15/26 29/715 |
| 2018/0126446 | A1* | 5/2018 | Mori | B21J 15/26 |
| 2019/0013763 | A1* | 1/2019 | Woyciesjes | H02P 29/40 |
| 2020/0238489 | A1* | 7/2020 | Mori | B21J 15/12 |

* cited by examiner

| | M3 | M4 | M5 | M6 | M8 | M10 | M12 |
|---|---|---|---|---|---|---|---|
| Aluminum | 1 | 15 | 25 | 55 | 70 | 75 | 90 |
| Steel | 10 | 35 | 55 | 80 | 85 | 90 | 99 |
| Stainless steel | 15 | 55 | 65 | 85 | 95 | 99 | - |

ELECTRIC RIVET NUT MACHINE

BACKGROUND OF THE INVENTION

Field of Invention

The invention relates to a rivet nut machine, and more particularly to a motor with bidirectional output capable of respectively driving different structures of the electric rivet nut machine.

Related Art

FIG. 1 shows a conventional electric rivet nut machine 10, which has a rivet nut drive unit 11 and a motor 12; the rivet nut drive unit 11 processes two actions, one of the actions is to rotate a head, so that the head can be screwed with a rivet nut (not shown in the figure), and the other action is to move the rivet nut drive unit 11, after the head is fixedly screwed with the rivet nut, the rivet nut is pulled toward the electric rivet nut machine 10 to deform the rivet nut, thereby riveting action can be completed. In order to achieve the two actions, the rivet nut drive unit 11 is provided with a moving gear 111 and a coupling gear 112; the coupling gear 112 can drive the rivet nut drive unit 11 to rotate, so that the rivet nut drive unit 11 can screw the rivet nut inward or outward; and the moving gear 111 can drive the rivet nut drive unit 11 to move toward the electric rivet nut machine 10 after the rivet nut drive unit 11 is screwed into the rivet nut, so that the rivet nut forms an action of riveting and fixing. In order for the motor 12 to simultaneously drive the moving gear 111 and the coupling gear 112 on the rivet nut drive unit 11 to rotate, the motor 12 is additionally engaged with a gear shaft 13; the gear shaft 13 provided with a first gear 131 and a second gear 132 is transversely disposed between the motor 12 and the rivet nut drive unit 11. The first gear 131 will engage with the moving gear 111; the second gear 132 will engage with the coupling gear 112, since the moving gear 111 and the coupling gear 112 are located at two ends of the motor 12 respectively, a length of the gear shaft 13 needs to be greater than a length of the motor 12 to be able to respectively engage with the moving gear 111 and the coupling gear 112; when the motor 12 rotates, it will drive the gear shaft 13 to rotate, in addition, the first gear 131 and the second gear 132 of the gear shaft 13 respectively drive the moving gear 111 and the coupling gear 112 on the rivet nut drive unit 11, and the coupling gear 112 and the moving gear 111 on the rivet nut drive unit 11 are driven to respectively perform actions of screwing with the rivet nut and pulling the rivet nut to compress in order to complete the action of fixedly riveting of the rivet nut; in another conventional electric rivet nut gun, in order to generate different rotation speeds to control the moving gear 111 and the coupling gear 112, two different motors are used for engaging, and rotation speeds of the moving gear 111 and the coupling gear 112 can be adjusted through rotation speeds of the two different motors.

Please refer to FIG. 2, in order to correspond to different materials and specifications of the rivet nut, a control panel 14 is provided on an outer side of the electric rivet nut machine 10. Users can input different values of 01-99 on the control panel 14 according to the type of use. Different materials and specifications are given corresponding values to change a torsion of the motor 12.

However, in the aforementioned prior art, the gear shaft 13 needs to be disposed horizontally between the motor 12 and the rivet nut drive unit 11, which will increase the distance between the motor 12 and the rivet nut drive unit 11.

In addition, the gear shaft 13 is directly engaged with the motor 12 and the rivet nut drive unit 11, and the space between the gear shaft 13 and the rivet nut drive unit 11 is limited, resulting in no other gear sets can be disposed between the motor 12 and the rivet nut drive unit 11 for proportioning rotation speeds, and therefore the gear ratio used by the moving gear 111 and the coupling gear 112 of the rivet nut drive unit 11 will be restricted. Although different speed ratios can be proportioned by using two different motor outputs, using two motors not only increases the costs and weight, two motors also consume relatively more electricity during operation, resulting in shortened operating time. In addition, although the control panel 14 can adjust the values to change the torsion output of the motor 12, the values need to be checked with a table of values and input correspondingly. If the user forgets the values corresponding to the material and specification of the rivet nut, the user needs to check with the table repeatedly, which causes inconvenience in use.

SUMMARY OF THE INVENTION

An object of the invention is to provide an electric rivet nut machine having a motor with bidirectional output capable of respectively driving a rivet nut drive unit.

Another object of the invention is to provide an electric rivet nut machine with a single motor having two output shafts with different output rotation speeds.

Yet another object of the invention is to provide an electric rivet nut machine that is easy to input parameters.

In order to achieve the above objects, the invention provides an electric rivet nut machine comprising:

a housing with an accommodating space inside;

a motor disposed in the accommodating space and having a first output shaft and a second output shaft; the first output shaft is connected with a first gear set, and the second output shaft is connected with a second gear set; and a rivet nut drive unit disposed in the accommodating space and having a rivet nut shaft, a coupling gear and a moving gear; the moving gear is engaged with the first gear set; and the coupling gear is engaged with the second gear set.

Preferably, the motor further has a body, the first output shaft and the second output shaft are disposed on two sides of the body respectively, and the first gear set and the second gear set are also respectively disposed on the two sides of the body.

Preferably, the first gear set comprises a first shaft gear and a first speed transforming gear shaft; the first shaft gear is disposed on the first output shaft, the first speed transforming gear shaft is pivotally disposed on the housing and has a first main gear and a first auxiliary gear, the first main gear is engaged with the first shaft gear; and the first auxiliary gear is engaged with the moving gear.

Preferably, the second gear set comprises a second shaft gear and a second speed transforming gear shaft; the second shaft gear is disposed on the second output shaft, the second speed transforming gear shaft is pivotally disposed on the housing and has a second main gear and a second auxiliary gear, the second main gear is engaged with the second shaft gear; and the second auxiliary gear is engaged with the coupling gear.

In the electric rivet nut machine provided by the invention, the motor can be respectively engaged with the coupling gear and the moving gear of the rivet nut drive unit from two end sides, so that the first gear set and the second gear set between the motor and the rivet nut drive unit can be adaptively matched with gear sets with different gear ratios, and the rivet nut drive unit is capable of producing a better gear ratio design according to the requirements of different gears.

BRIEF DESCRIPTION OF THE DRAWINGS

In order to enable the examiner to further understand the objects, features, and achieved efficacies of the invention, two preferred embodiments are described below for detailed explanation in conjunction with the drawings, in which.

DETAILED DESCRIPTION OF THE INVENTION

Figure 1:
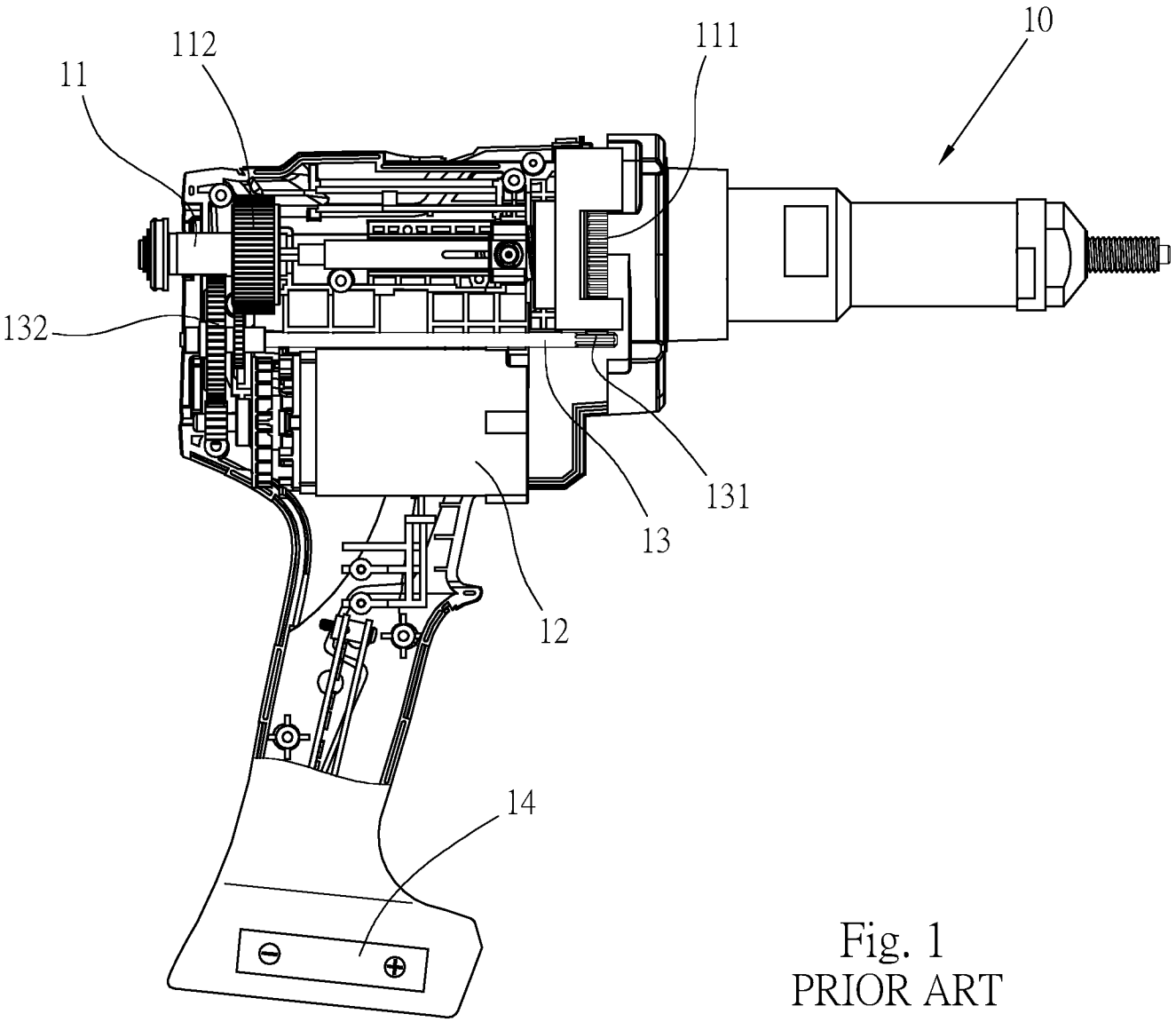
Fig. 1 PRIOR ART
FIG. 1 is a diagram of an internal structure of a conventional electric rivet nut machine.
Figure 2:
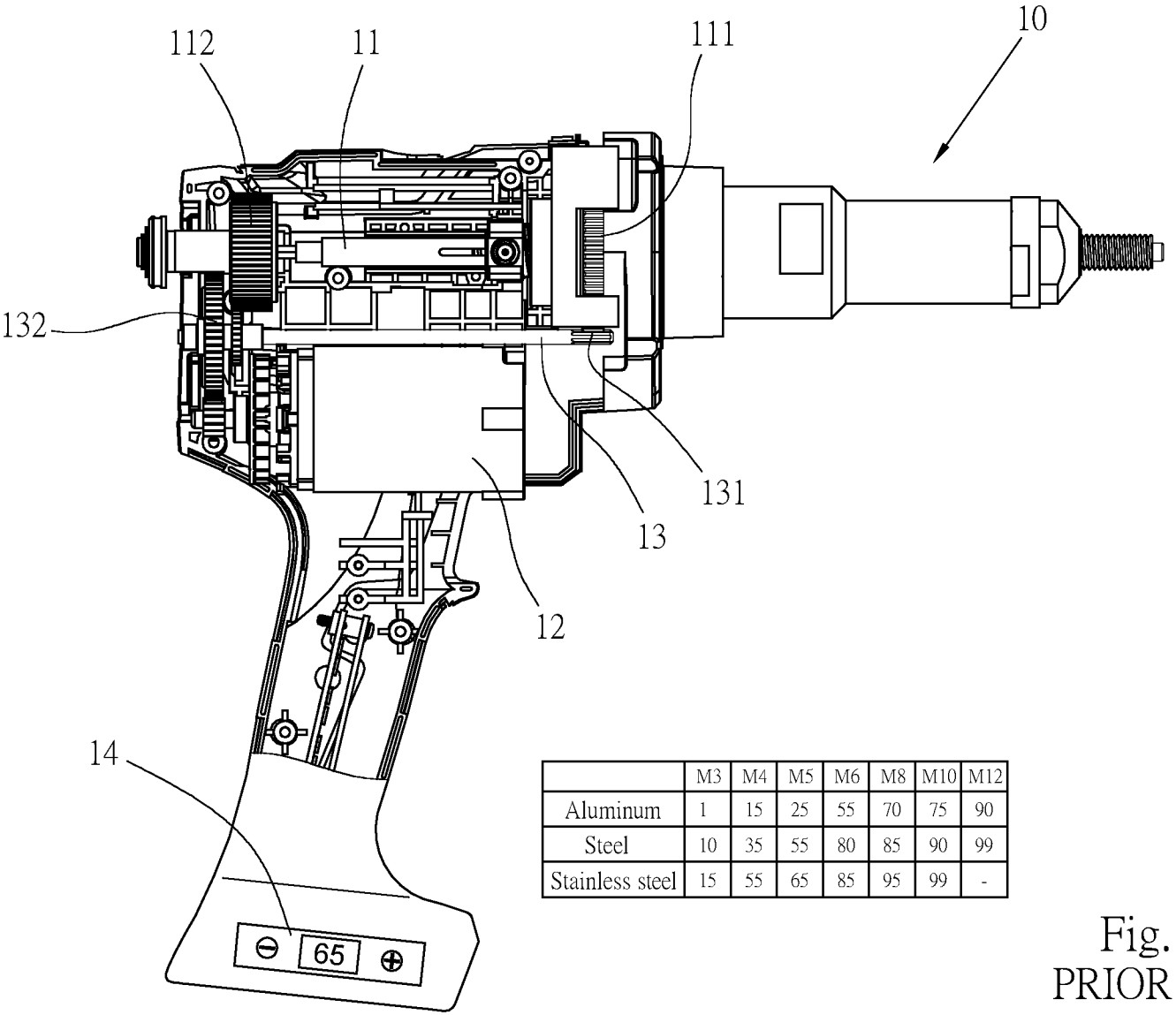
Fig. 2 PRIOR ART
FIG. 2 is a schematic diagram of a control panel and a look-up table of the conventional electric rivet nut machine.
Figure 3:
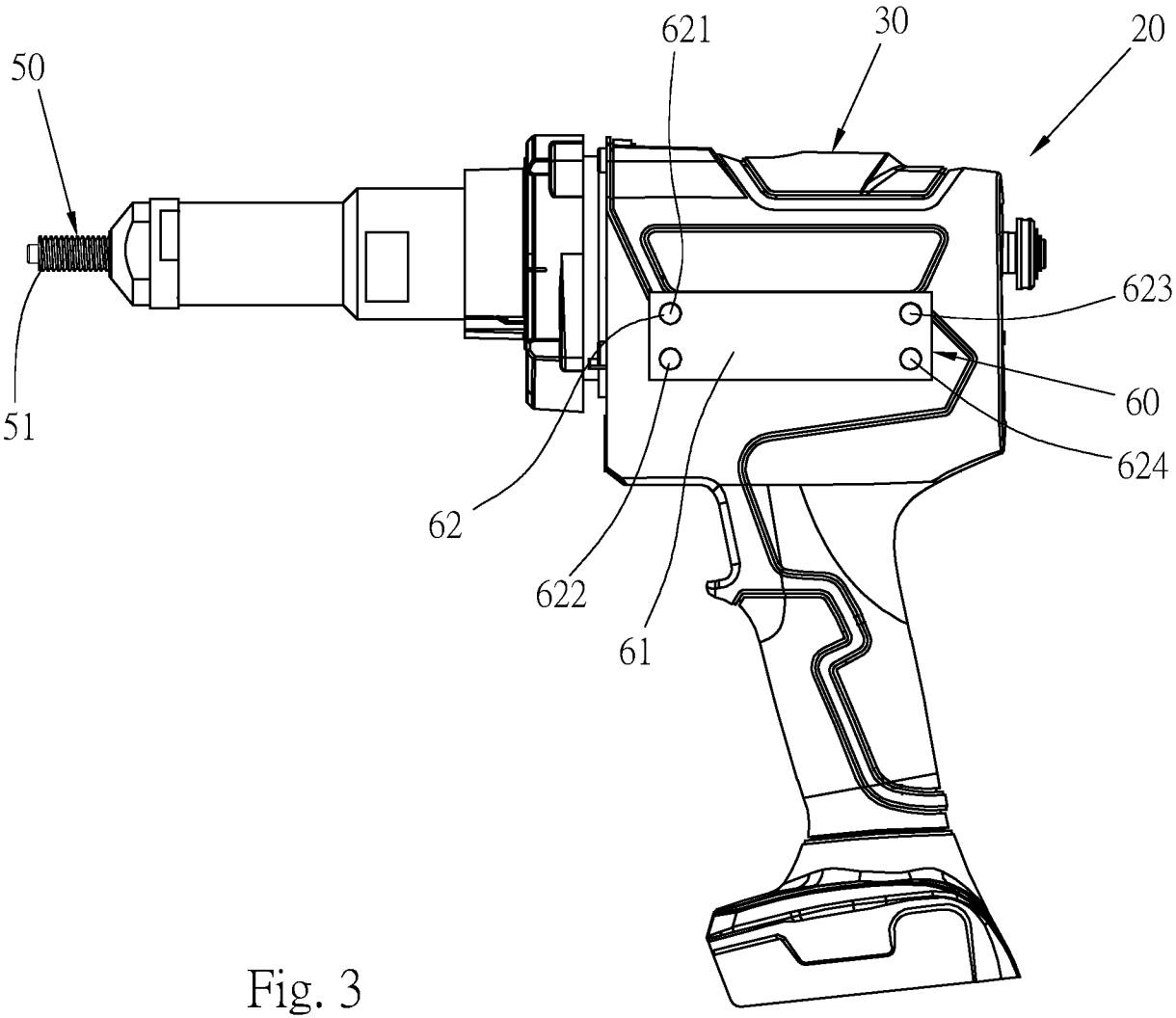
FIG. 3 is a perspective view of an electric rivet nut machine according to a preferred embodiment of the invention.
Figure 4:
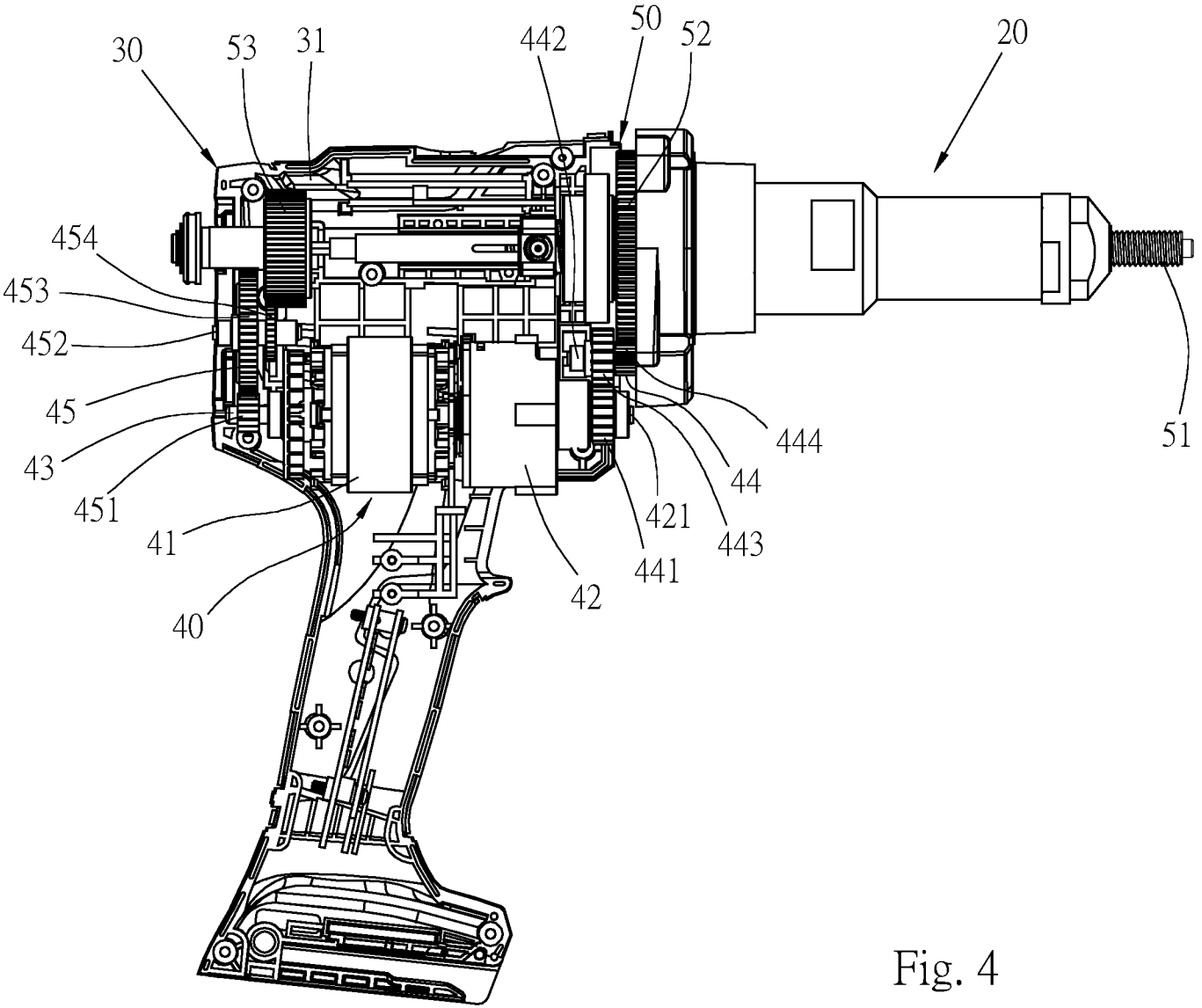
FIG. 4 is an assembly diagram of a motor and a rivet nut drive unit of the electric rivet nut machine according to a preferred embodiment of the invention.
Figure 5:
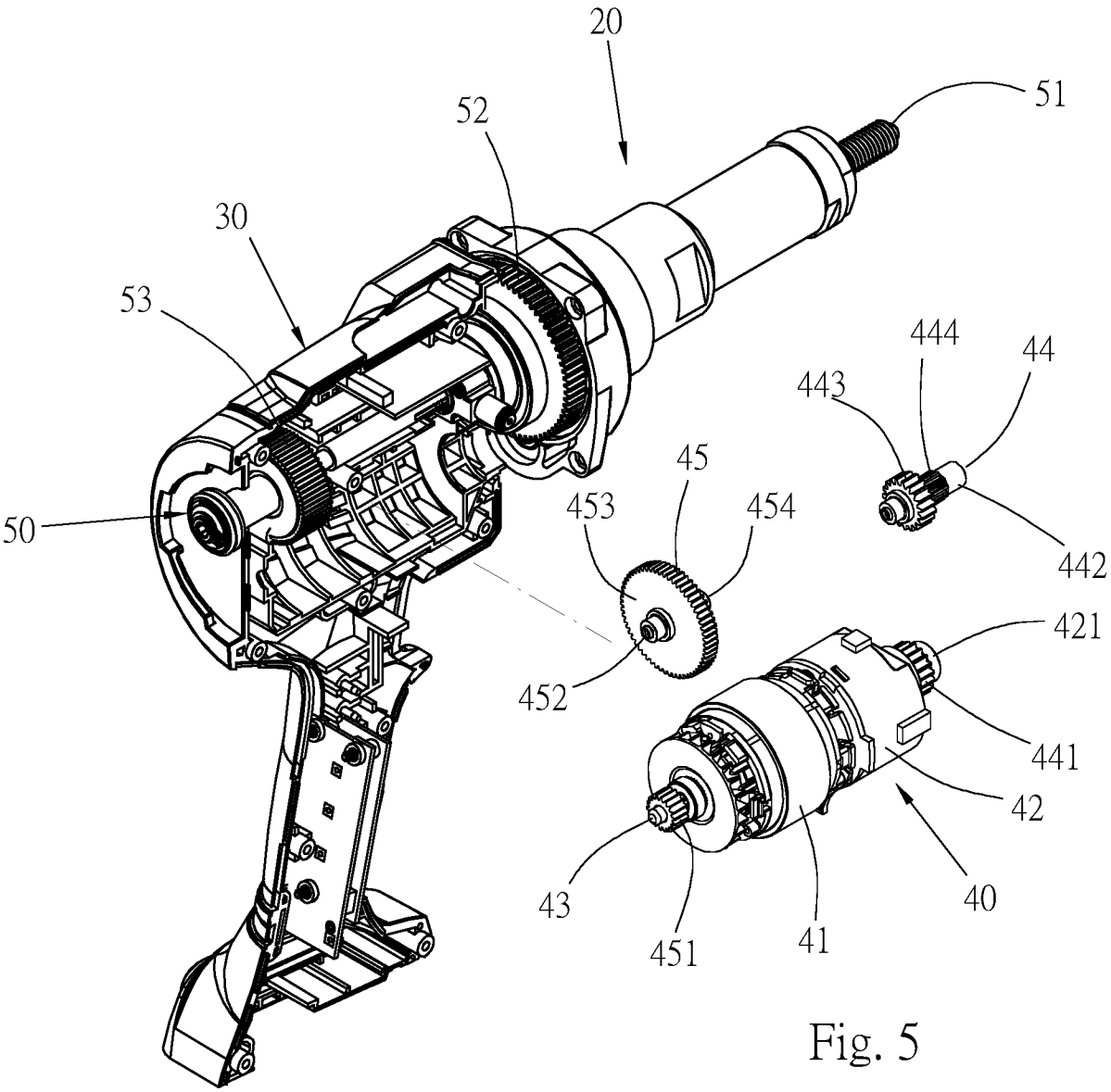
FIG. 5 is a perspective exploded view of the motor and gear sets according to a preferred embodiment of the invention.

Please refer to FIGS. 3 to 5 for an electric rivet nut machine 20 provided by a preferred embodiment of the invention, which mainly comprises a housing 30 with an accommodating space 31 inside; a motor 40; a rivet nut drive unit 50; and a control unit 60.

Please refer to FIGS. 4 and 5. The motor 40 is disposed at a lower position of the accommodating space 31, and has a body 41, a reduction gear set 42 and a second output shaft 43. A front end of the reduction gear set 42 is provided with a first output shaft 421, the first output shaft 421 is connected with a first gear set 44, the second output shaft 43 is connected with a second gear set 45, the first gear set 44 and the second gear set 45 are respectively located on two sides of the body 41. The second output shaft 43 is formed by a rotor of the motor 40, another end of the rotor is disposed in the reduction gear set 42, so that an output rotation speed of the rotor of the motor 40 will be decelerated through the reduction gear set 42, and a speed difference is formed between the first output shaft 421 and the second output shaft 43. A first stage of speed adjustment and allocation is performed through different speed outputs, which is equivalent to using two different motors for different rotation speed outputs. The first gear set 44 has a first shaft gear 441 and a first speed transforming gear shaft 442; the first shaft gear 441 is disposed on the first output shaft 421, the first speed transforming gear shaft 442 is pivotally disposed on a front side of the housing 30, and has a first main gear 443 and a first auxiliary gear 444. The first main gear 443 is engaged with the first shaft gear 441 so that the first shaft gear 441 is capable of driving the first main gear 443 and the first auxiliary gear 444 to rotate. In this embodiment, since the reduction gear set 42 has already performed the first stage of deceleration on the rotor of the motor 40 to decelerate a rotation speed of the first output shaft 421, a gear ratio between the first shaft gear 441 and the first main gear 443 of the first gear set 44 is 1:1. The reduction gear set 42 can be omitted in the design to have the first output shaft 421 directly connected to the rotor of the motor 40, and the first stage of deceleration can be performed through setting of a gear ratio between the first shaft gear 441 and the first main gear 443. The second gear set 45 comprises a second shaft gear 451 and a second speed transforming gear shaft 452, the second shaft gear 451 is disposed on the second output shaft 43, the second speed transforming gear shaft 452 is pivotally disposed on a rear side of the housing 30, and has a second main gear 453 and a second auxiliary gear 454. The second main gear 453 is engaged with the second shaft gear 451 so that the second shaft gear 451 is capable of driving the second main gear 453 and the second auxiliary gear 454 to rotate. A quantity of teeth of the second shaft gear 451 is less than a quantity of teeth of the second main gear 453, so that a first stage deceleration can be generated. Through the design of the reduction gear set 42, the first output shaft 421 and the second output shaft 43 output by the motor 40 can be formed to have different rotation speeds, it does not need to be equipped with two motors to achieve the operation of changing rotation speeds, and a gear ratio and a quantity of gears of the first gear set 44 and the second gear set 45 can be replaced and adjusted. Difference in gear ratio between the first gear set 44 and the second gear set 45 can be used to change rotation speed and torsion. In addition, the change of the gear ratio between the first gear set 44 and the second gear set 45, as well as positions between the motor 40 and the rivet nut drive unit 50 can be adjusted and changed, so that gear ratio and ratio of quantity of gears can be easily designed, the design can be changed according to different fields or specifications, output power and speed can be configured without limitation, and different requirements can be met through proportioning of multiple gears.

Please refer to FIG. 4, the rivet nut drive unit 50 is disposed at an upper position of the accommodating space 31, and has a rivet nut shaft 51, a moving gear 52 and a coupling gear 53; the moving gear 52 is engaged with the first auxiliary gear 444 of the first gear set 44, and a quantity of teeth of the first auxiliary gear 444 is less than a quantity of teeth of the moving gear 52, so that a second stage of deceleration is formed between the first auxiliary gear 444 and the moving gear 52. The coupling gear 53 is engaged with the second auxiliary gear 454 of the second gear set 45, a quantity of teeth of the second auxiliary gear 454 is less than a quantity of teeth of the coupling gear 53, so that a second stage of deceleration is formed between the second auxiliary gear 454 and the coupling gear 53. The rivet nut shaft 51 is protruded outside of the housing 30, the rivet nut shaft 51 is provided with external screw threads on an outer side, and can be driven by the moving gear 52 and the coupling gear 53 to produce forward and backward displacements and combination action. The structure of the rivet nut drive unit 50 is a conventional structure, which will not be repeated here.

The control unit 60 is electrically connected to the motor 40, and is provided with a display panel 61 and a button set 62. The display panel 61 comprises a material display area 611, a specification display area 612, and a fine adjustment display area 613. The button set 62 is provided with a material selection button 621, a specification selection button 622, a fine adjustment selection button 623 as well as a saving and reading button 624 in corresponding to the display panel 61. The material selection button 621 can be pressed to select a corresponding material of a rivet nut which is displayed through the material display area 611, such as A for aluminum, S for steel, E for stainless steel, etc., with different English codes representing different materials. The specification selection button 622 can be pressed to select a specification of the rivet nut which is displayed through the specification display area 612 and is generally a two-digit display. The fine adjustment selection button 623 can be used for fine-tuning set specification and material due to a material of a construction location or other factors, fine-tuned with positive and negative values, and displayed through the fine adjustment display area 613. In addition, through the saving and reading button 624, set commonly used values can be stored, and can be read when using the same specification to speed up an adjustment speed.

Figure 6:
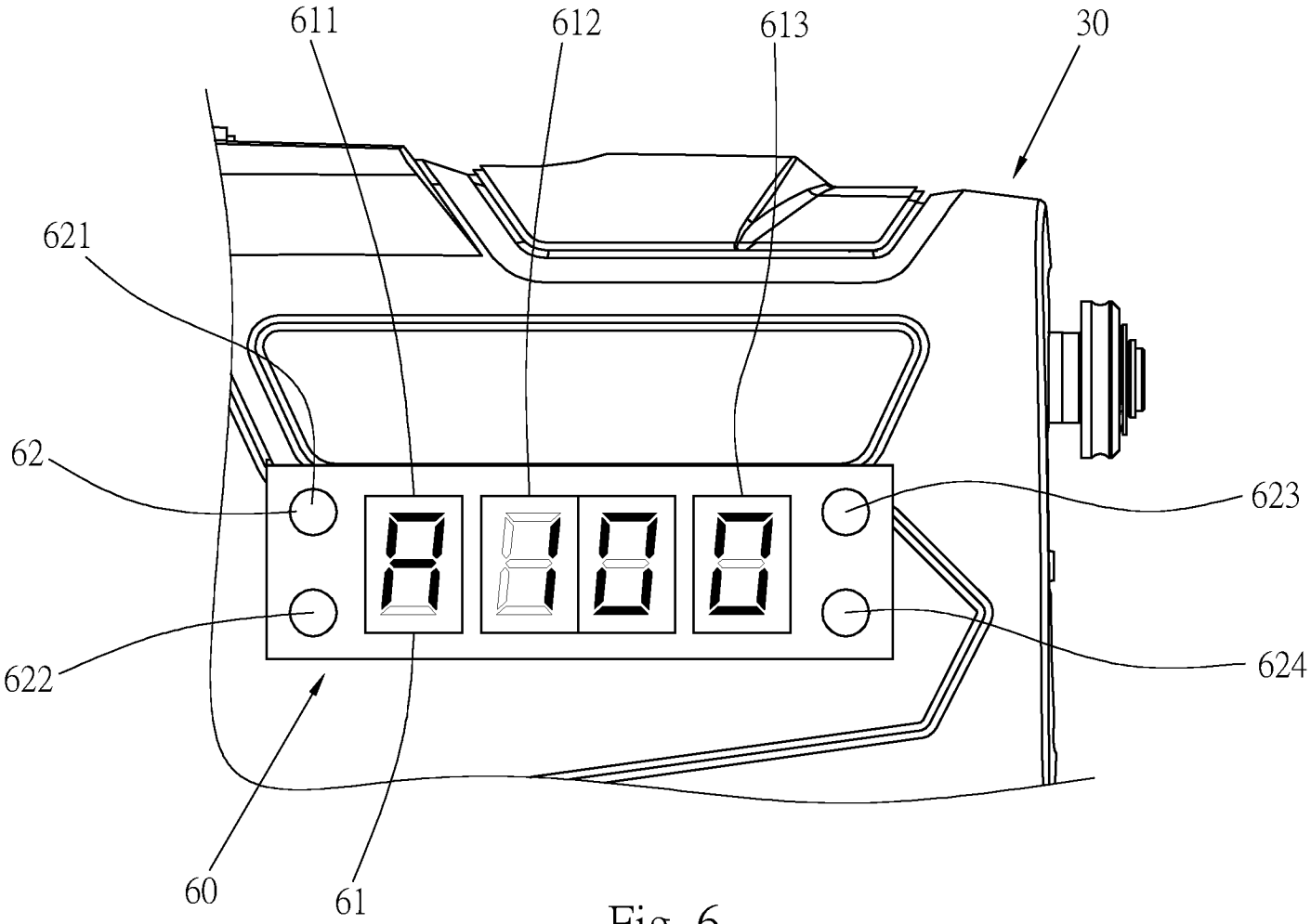
FIG. 6 is a schematic diagram of setting of a control unit of the electric rivet nut machine according to a preferred embodiment of the invention.

Please refer to FIG. 6. When the electric rivet nut machine 20 of this embodiment is in use, various parameters can be set through the control unit 60 first. Through different parameter settings, in addition to allowing a user to clearly know the specification of the current operation through the display panel 61, setting can be done directly according to the specification used, without having to check a table, which can be used intuitively, is capable of reducing the complexity of operation, and can be used directly. After adjustment is completed, the motor 40 can be set through the control unit 60 so that the motor 40 is capable of generating a corresponding torsion output.

Please refer to FIGS. 3 and 4, when the motor 40 is driven for actions of riveting and pulling a rivet nut electrically, the motor 40 will simultaneously drive the reduction gear set 42 and the second output shaft 43 to cause the first output shaft 421 on the reduction gear set 42 to drive the engaged first gear set 44 to rotate, and the second output shaft 43 to drive the engaged second gear set 45 to rotate. At this time, the first auxiliary gear 444 and the second auxiliary gear 454 respectively drive the moving gear 52 and the coupling gear 53 to rotate synchronously, so that the rivet nut shaft 51 can be screwed into a rivet nut (not shown in the figures), and then retract toward the electric rivet nut machine 20, thereby the rivet nut produces a pressing and riveting action. Then, withdraw the rivet nut shaft 51 to complete an action.

Figure 7:
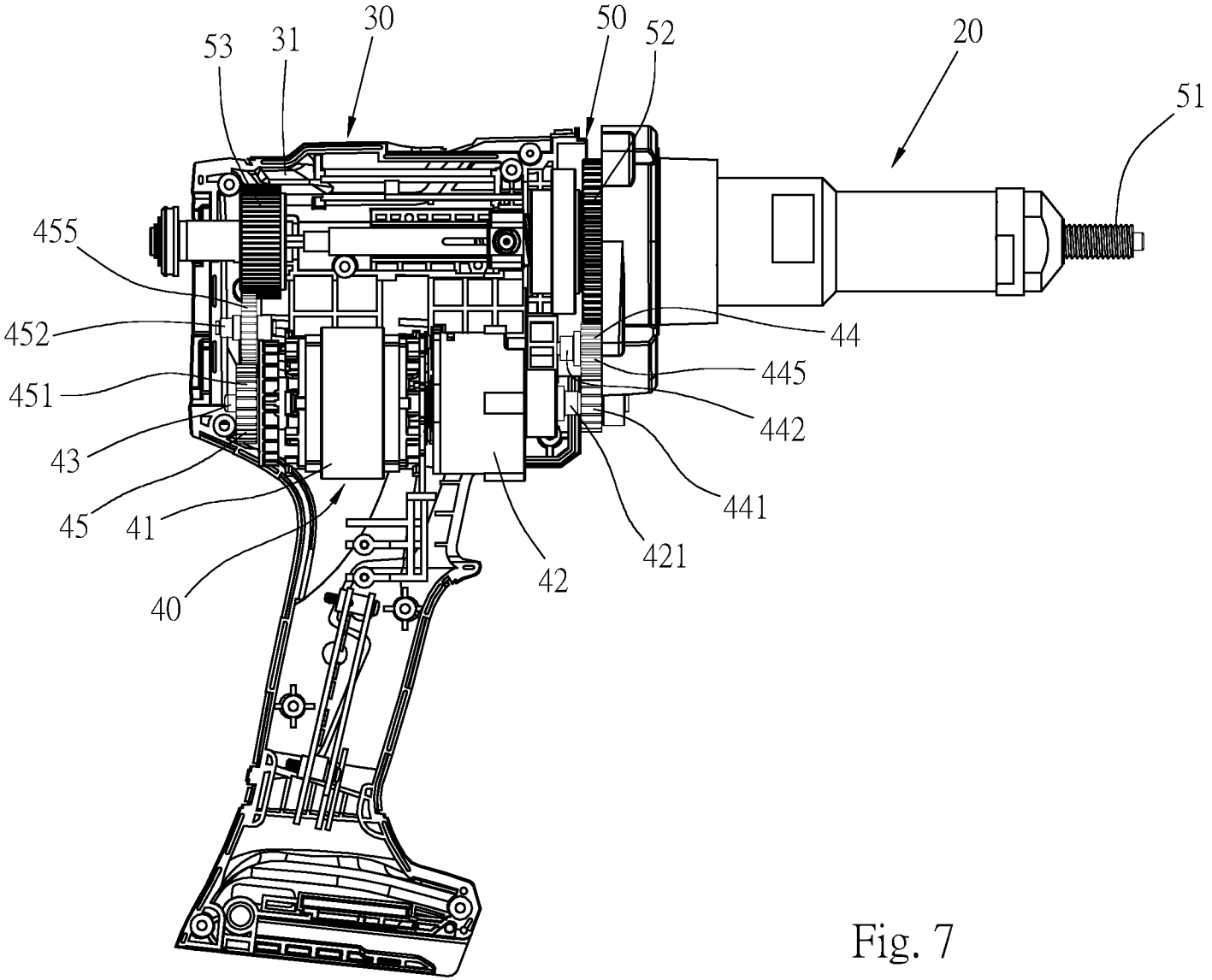
FIG. 7 is an assembly diagram of the motor and the rivet nut drive unit of the electric rivet nut machine according to a second preferred embodiment of the invention.

Please refer to FIG. 7 for a second preferred embodiment provided by the invention. Its main structures are the same as that of the previous embodiment. The same structures are represented by the same referenced numerals which will not be repeated, wherein:

the first gear set 44 is provided with only a first transmission gear 445 on the first speed transforming gear shaft 442; between the first shaft gear 441 on the first output shaft 421 and the moving gear 52 of the rivet nut drive unit 50 is engaged with the first transmission gear 445; in addition, the second gear set 45 is also provided with only a second transmission gear 455 on the second speed transforming gear shaft 452; between the second shaft gear 451 on the second output shaft 43 and the coupling gear 53 of the rivet nut drive unit 50 is engaged with the second transmission gear 455; with the first and second gear sets 44, 45 directly driving the moving gear 52 and the coupling gear 53 through the first transmission gear 445 and the second transmission gear 455, a quantity of gears being used can be reduced, and a loss of power transmission can be reduced; and assembly can be coordinated and matched according to power requirements or rotation speed requirements, that is, quantities of gears provided in the first gear set 44 and the first gear set 44 can be adjusted, without being limited by the embodiments of the invention.

In the electric rivet nut machine of the invention, the motor has the two output shafts, which are capable of respectively engaging with and driving the two different gears of the rivet nut drive unit. Compared with the conventional motor with only one output shaft and requiring a gear shaft to be disposed between the rivet nut drive unit and the motor, the two output shafts of the motor of the invention are capable of outputting two different rotation speed configurations, and with the motor being disposed with the two different externally connected gear sets, gear ratio can be easily designed for different requirements to increase an efficiency of the electric rivet nut machine. In addition, the control unit of the invention can be set in an intuitive way, and does not require to check the table, compared with the conventional simple numerical presentation and the need to check the table correspondingly, trouble of setting during operation can be reduced and the convenience of operation can be improved.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. An electric rivet nut machine comprising:

a housing with an accommodating space inside;

a motor disposed in the accommodating space and having a first output shaft and a second output shaft; the first output shaft being connected with a first gear set, and the second output shaft being connected with a second gear set; and a rivet nut drive unit disposed in the accommodating space and having a rivet nut shaft, a coupling gear and a moving gear; the coupling gear being engaged with the second gear set; and the moving gear being engaged with the first gear set; wherein the second output shaft is a rotor of the motor.

2. The electric rivet nut machine as claimed in claim 1, wherein the motor further has a body, the first output shaft and the second output shaft are disposed on two sides of the body respectively, and the first gear set and the second gear set are also respectively disposed on the two sides of the body.

3. The electric rivet nut machine as claimed in claim 2, wherein the first gear set comprises a first shaft gear and a first speed transforming gear shaft; the first shaft gear is disposed on the first output shaft, the first speed transforming gear shaft is pivotally disposed on the housing and has a first main gear and a first auxiliary gear, the first main gear is engaged with the first shaft gear; and the first auxiliary gear is engaged with the moving gear.

4. The electric rivet nut machine as claimed in claim 2, wherein the first gear set comprises a first shaft gear and a first speed transforming gear shaft; the first shaft gear is disposed on the first output shaft, the first speed transforming gear shaft is disposed on the housing and has a first transmission gear; and the first shaft gear drives the moving gear by the first transmission gear.

5. The electric rivet nut machine as claimed in claim 2, wherein a reduction gear set is disposed between the first output shaft and the motor.

6. The electric rivet nut machine as claimed in claim 2, wherein the second gear set comprises a second shaft gear and a second speed transforming gear shaft; the second shaft gear is disposed on the second output shaft, the second speed transforming gear shaft is pivotally disposed on the housing and has a second main gear and a second auxiliary gear, the second main gear is engaged with the second shaft gear; and the second auxiliary gear is engaged with the coupling gear.

7. The electric rivet nut machine as claimed in claim 2, wherein the second gear set comprises a second shaft gear and a second speed transforming gear shaft; the second shaft gear is disposed on the second output shaft, the second speed transforming gear shaft is disposed on the housing and has a second transmission gear; and the second shaft gear drives the coupling gear by the second transmission gear.

8. The electric rivet nut machine as claimed in claim 1, wherein the first gear set comprises a first shaft gear and a first speed transforming gear shaft; the first shaft gear is disposed on the first output shaft, the first speed transforming gear shaft is pivotally disposed on the housing and has a first main gear and a first auxiliary gear, the first main gear is engaged with the first shaft gear; and the first auxiliary gear is engaged with the moving gear.

9. The electric rivet nut machine as claimed in claim 1, wherein the first gear set comprises a first shaft gear and a first speed transforming gear shaft; the first shaft gear is disposed on the first output shaft, the first speed transforming gear shaft is disposed on the housing and has a first transmission gear; and the first shaft gear drives the moving gear by the first transmission gear.

10. The electric rivet nut machine as claimed in claim 1, wherein a reduction gear set is disposed between the first output shaft and the motor.

11. The electric rivet nut machine as claimed in claim 1, wherein the second gear set comprises a second shaft gear and a second speed transforming gear shaft; the second shaft gear is disposed on the second output shaft, the second speed transforming gear shaft is pivotally disposed on the housing and has a second main gear and a second auxiliary gear, the second main gear is engaged with the second shaft gear; and the second auxiliary gear is engaged with the coupling gear.

12. The electric rivet nut machine as claimed in claim 1, wherein the second gear set comprises a second shaft gear and a second speed transforming gear shaft; the second shaft gear is disposed on the second output shaft, the second speed transforming gear shaft is disposed on the housing and has a second transmission gear; and the second shaft gear drives the coupling gear by the second transmission gear.

13. The electric rivet nut machine as claimed in claim 1, further comprising a control unit electrically connected to the motor, and provided with a display panel and a button set.

14. The electric rivet nut machine as claimed in claim 13, wherein the display panel comprises a material display area and a specification display area, and the button set comprises at least one material selection button and at least one specification selection button.

15. The electric rivet nut machine as claimed in claim 14, wherein the display panel further comprises a fine adjustment display area; and the button set further comprises at least one fine adjustment selection button.

16. The electric rivet nut machine as claimed in claim 15, wherein the button set further comprises a saving and reading button.

17. The electric rivet nut machine as claimed in claim 14, wherein the button set further comprises a saving and reading button.

* * * * *